US012129667B2

(12) United States Patent
Mineo

(10) Patent No.: US 12,129,667 B2
(45) Date of Patent: Oct. 29, 2024

(54) WALLBOARD-FASTENING DEVICE FOR SECURING WALLBOARDS IN AN OUTSIDE-CORNER CONFIGURATION

(71) Applicant: TRUE CORNERS, LLC, Osprey, FL (US)

(72) Inventor: Charles W. Mineo, Ft. Lauderdale, FL (US)

(73) Assignee: TRUE CORNERS, LLC

( * ) Notice: Subject to any disclaimer, the term of this patent is extended or adjusted under 35 U.S.C. 154(b) by 53 days.

(21) Appl. No.: 17/822,941

(22) Filed: Aug. 29, 2022

(65) Prior Publication Data

US 2023/0068997 A1 Mar. 2, 2023

Related U.S. Application Data

(60) Provisional application No. 63/238,520, filed on Aug. 30, 2021.

(51) Int. Cl.
*E04F 19/06* (2006.01)
*E04F 13/06* (2006.01)

(52) U.S. Cl.
CPC ..... *E04F 19/064* (2013.01); *E04F 13/06* (2013.01); *E04F 2013/063* (2013.01)

(58) Field of Classification Search
CPC ... E04F 19/064; E04F 13/06; E04F 2013/063; E04F 19/061
See application file for complete search history.

(56) References Cited

U.S. PATENT DOCUMENTS

| | | | | |
|---|---|---|---|---|
| 1,804,564 | A | 5/1931 | McChesney | |
| 2,379,179 | A | 6/1945 | Peterson | |
| 3,206,806 | A | 9/1965 | Powell | |
| 3,445,972 | A | 5/1969 | Carr | |
| 3,989,397 | A | 11/1976 | Baker | |
| 5,531,050 | A | 7/1996 | Stibolt et al. | |
| 5,974,748 | A | 11/1999 | Sciuga et al. | |
| 6,341,458 | B1 | 1/2002 | Burt | |
| 8,061,105 | B2 | 11/2011 | Haga | |
| 2003/0024188 | A1* | 2/2003 | Smythe, Jr. ..... | E04F 13/06 52/287.1 |
| 2005/0257461 | A1 | 11/2005 | Daly, IV | |

(Continued)

FOREIGN PATENT DOCUMENTS

| | | | |
|---|---|---|---|
| WO | 2019014495 | A1 | 1/2019 |
| WO | 2020168301 | A1 | 8/2020 |

*Primary Examiner* — Patrick J Maestri
(74) *Attorney, Agent, or Firm* — Cozen O'Connor

(57) ABSTRACT

A wallboard-fastening device for securing first and second wallboards to a framing member in an outside-corner configuration includes: first and second framing panels that connect to each other to form an inner corner seam that fits against the framing member; first and second corner panels that connect to each other to form an outer corner seam; a first bridge panel that connects to (i) the first corner panel to form a first outer seam and (ii) the inner corner seam; a second bridge panel that connects to (i) the second corner panel to form a second outer seam and (ii) the inner corner seam; a first flat-spring flange that connects to the first outer seam to form a first channel sized to accept the first wallboard; and a second flat-spring flange that connects to the second outer seam to form a second channel sized to accept the second wallboard.

17 Claims, 12 Drawing Sheets

(56) References Cited

U.S. PATENT DOCUMENTS

2006/0283115 A1* 12/2006 Robertson ..... B29C 66/304
52/364
2012/0304568 A1 12/2012 Aboukhalil

* cited by examiner

WALLBOARD-FASTENING DEVICE FOR SECURING WALLBOARDS IN AN OUTSIDE-CORNER CONFIGURATION

RELATED APPLICATIONS

This application claims priority to U.S. Provisional Patent Application No. 63/238,520, filed on Aug. 30, 2021, the entirety of which is incorporated herein by reference.

BACKGROUND

The goal of a wallboard installation is safe, structurally-sound, durable, and aesthetically-pleasing wall and/or ceiling surfaces in commercial and residential applications.

SUMMARY

Prior-art wallboard installation methods (e.g., see *Application and Finishing of Gypsum Panel Products*, GA-216-2018, published in 2018 by the Gypsum Association) teach that a wallboard panel is first fastened to a framing member using fasteners that pass through the wallboard panel into the framing member. At the seam, or joint, created where two adjacent wallboard panels abut, "joint tape" is applied over the joint and a "joint compound" or "mud" is spread or "buttered" over the joint tape on an even plane to finish the joint to a level that is perceptibly smooth relative to the rest of the wallboard surfaces. The joint tape and joint compound should cover fastener heads visible after the wallboard panel is fastened to the framing member so that the fastener heads are not visible after installation. Wallboard accessories such as trim, beads (e.g., corner beads, casing beads), and control joints (i.e. expansion joints) may be used at corners, or in other specific conditions. After the joint compound has dried or cured, the dried areas may be sanded or smoothed to eliminate high spots and excess joint compound. The surface finish may be improved by repeatedly applying joint compound and smoothing the repeatedly-applied joint compound after it has dried.

The present embodiments include wallboard-fastening devices that secure wallboard panels against a framing element in an outside-corner configuration. These wallboard-fastening devices press against an edge of each wallboard continuously along the entire length of the edge, advantageously increasing structural integrity and increasing resistance to shear forces as compared to prior-art installation methods that teach securing a wallboard panel with fasteners placed apart every 16 inches (e.g., as required by some building codes). In fact, the present embodiments do not require any fasteners to pass through the wallboard panels, thereby eliminating the need to cover fastener heads that may be visible after fastening with prior-art installation methods. By eliminating fasteners that pass through the wallboard, several types of installation errors that commonly occur with prior-art methods may be avoided, such as improperly-installed fasteners that may compromise the strength of the wallboard panel and/or its attachment to the underlying framing member. Examples of improperly-installed fasteners include fasteners of the wrong type, fasteners driven so far into the wallboard panel that they penetrate past the outer paper facing of the wallboard panel, fasteners that are not installed at prescribed distances along the edge of a wallboard panel (e.g., every 16 inches), fasteners that pass too close to an edge of the wallboard panel, and fasteners that are too short to sufficiently penetrate the underlying framing member.

The above examples of installation errors are frequently the result of human error, job shortcuts, and/or improper training of wallboard installers (e.g., contractors, laborers). Thus, the present embodiments advantageously speed up installations by simplifying the installation, thereby reducing the number of errors and the amount of skill and training needed for wallboard installers. The embodiments also advantageously reduce waste and cost by minimizing materials (i.e., wallboards, joint tape, joint compound) that must be replaced when an installation error occurs.

The present embodiments also visibly cover the gap, joint, or seam between two adjacent wallboard panels, advantageously creating a treated joint without applying joint tape while avoiding the time-consuming steps of repeated applications of joint compound followed by sanding of each joint compound application. By completely removing joint tape and optionally joint compound, the present embodiments further improve structural integrity by avoiding inadequately- and/or inappropriately-applied joint tape and/or joint compound.

To achieve what is referred to in the art as a level-5 finish (i.e., the level of finish requiring the most labor and skill, often used in high-end residential construction), a wallboard installer may apply a "skim coat" over the installed wallboard panels and any exposed portions of the wallboard-fastening device. The skim coat may be applied using joint compound, plaster or any other approved skim coat finish material. The skim coat may be applied directly over the seam formed between an edge of the installed wallboard-fastening device and the visible side of the corresponding installed wallboard panels. The skim coat thus hides the seams without the need for any joint tape and/or previously applied joint compound, achieving in one day what takes several days with prior-art wallboard installation methods.

Any of the wallboard-fastening devices described herein may be affixed to an underlying framing member with fasteners that, unlike prior-art installation methods, do not pass through the wallboard panels. Once a wallboard panel is physically secured by insertion of the panel edge into the affixed wallboard-fastening device, the wallboard panel is firmly secured and sealed to the underlying framing member continuously along the entire length of the wallboard panel without any joint tape and/or joint compound. However, additional fasteners may be passed through the wallboard panel to further secure the wallboard panel to the underlying framing member.

Another advantage of the present embodiments is significantly reduced sound transmission. Due to this advantage, the present embodiments may be used as an easier-to-install alternative to resilient channel systems. Presented below are the results of a sound transmission loss test demonstrating a sound transmission class (STC) rating of 53. When used as an alternative to resilient channel, the present embodiments offer improved strength. The standard for transverse load in many current construction codes (e.g., see Section 3.2 of ICC-ES AC271) is a rating of 15 pounds per square foot (psf). Also presented below are results of a transverse-load test demonstrating an average ultimate pressure of 32 psf. Accordingly, the present embodiments can be used to create wallboard installations that are at least 50% stronger than those using prior-art resilient channel.

The present embodiments may be used with similar wallboard-mounting devices for butt joints and inside-corner joints to create a complete wallboard installation system. Examples of such wallboard-mounting devices for butt joints and inside corners can be found in International Publication No. WO 2020/168301 A1, which is incorporated herein by reference in its entirety. Many of the advantages described above also apply to the wallboard-mounting devices described in this reference. The present embodiments may be installed similarly to the outside-corner wallboard-mounting devices described in this reference.

DETAILED DESCRIPTION

Definitions

Wallboard: a flat panel used for constructing interior walls and ceilings that frequently, although not necessarily, includes gypsum as the base material. The term "wallboard", as used herein, includes drywall, plasterboard, sheet rock, gyprock, gypsum board, backing board, coreboard, greenboard, blueboard, cement board, soundboard, ceiling board, and the like.

Framing Member: that portion of framing, furring, bridging, blocking, etc., to which panel products are attached. Wall studs and ceiling joints are examples of framing members. A framing member may be constructed of steel, wood, or another rigid material.

Fastener: nails, screws, or staples used to mechanically affix wallboard panels.

Treated Joint: a joint between wallboard panels that is reinforced and concealed with tape and joint compound, or covered by strip moldings.

Finishing: the act of concealing joints, typically implemented with joint compound and tape; includes concealing fastener heads (when present) and edges or flanges of accessories.

Control Joint: a designed separation between neighboring wallboard panels that allows for movement caused by expansion and/or contraction of wallboard panels, framing members, and/or other components used to fasten and finish the wallboard panels.

Figure 1:
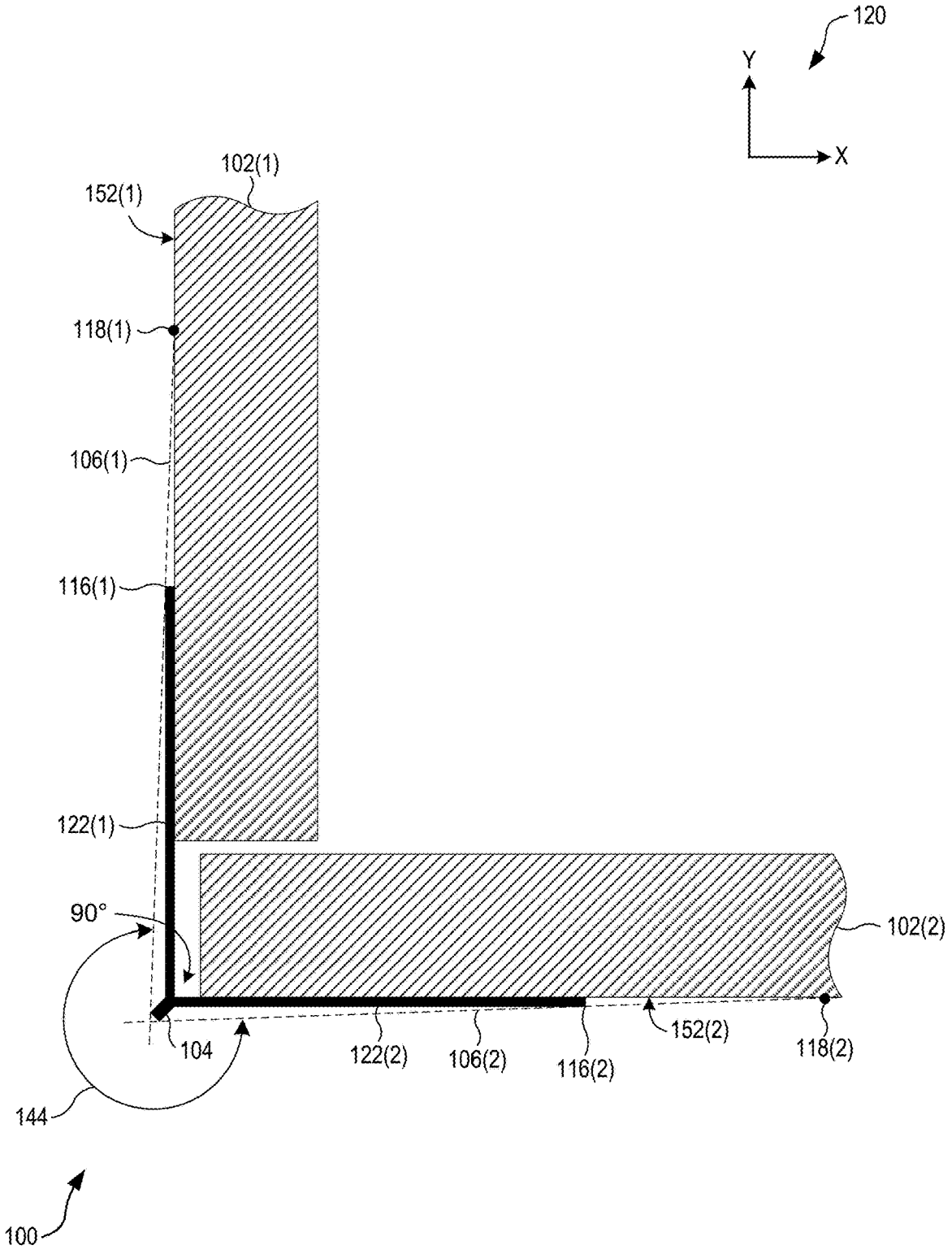
FIG. 1 (PRIOR ART)
FIG. 1 is a cross-sectional view of a prior-art corner bead used to strengthen an outside corner formed where first and second wallboard panels meet.

FIG. 1 is a cross-sectional view of a prior-art corner bead 100 used to strengthen an outside corner formed where a first wallboard panel 102(1) meets a second wallboard panel 102(2). The corner bead 100 has a first flange 122(1) that contacts part of a first outward-facing surface 152(1) of the first wallboard panel 102(1), and a second flange 122(2) that contacts part of a second outward-facing surface 152(2) of the second wallboard panel 102(2). As shown in FIG. 1, the flanges 122(1) and 122(2) are perpendicular to each other, and therefore form a 90° angle. The corner bead 100 also includes a nose 104 that reinforces the corner, making it less prone to damage. The corner bead 100 also covers the seam formed between the wallboard panels 102(1) and 102(2), thereby making the outside corner appear more uniform in texture. The corner bead 100 is typically fabricated from vinyl, metal, or paper-coated metal.

As shown in FIG. 1, a lengthwise edge (i.e., in the z direction; see right-handed coordinate system 120) of the nose 104 extending farthest in the −x direction cooperates with a first distal lengthwise edge 116(1) of the first flange 122(1) to define a first plane 106(1) that intersects the first outward-facing surface 152(1) at a first intersection point 118(1). Similarly, a lengthwise edge of the nose 104 extending farthest in the −y direction cooperates with a second distal lengthwise edge 116(2) of the second flange 122(2) to define a second plane 106(2) that intersects the second outward-facing surface 152(2) at a second intersection point 118(2).

Mud may be applied over the nose 104, flanges 102(1) and 102(2), and outward-facing surfaces 152(1) and 152(2). After drying, the mud may be sanded down, or otherwise finished, to the region approximately bounded by the first plane 106(1), nose 104, first flange 122(1), and first outward-facing surface 152(1) to create a visibly smooth surface that covers and hides the transition where the first distal lengthwise edge 116(1) meets the first wallboard panel 102(1). The dried mud may be similarly sanded down to the region bounded by the second plane 106(2), nose 104, second flange 122(2), and second outward-facing surface 152(2) to create a visibly smooth surface that covers and hides the transition where the second distal lengthwise edge 116(2) meets the second wallboard panel 102(2). The mud may deviate from the planes 106(1) and 106(2) near the distal lengthwise edges 116(1) and 116(2) to create smoother transitions with the wallboard panels 102(1) and 102(2), thereby avoiding the formation of kinks where the mud meets the wallboard panels 102(1) and 102(2). Paint, joint compound, spray, roll-on texture, or another type of surface treatment may be applied instead of mud.

Due to the nose 104, the planes 106(1) and 106(2) form an outside corner angle 144 that is greater than 270° even though the wallboard panels 102(1) and 102(2) are perpendicular to each other (i.e., the outward-facing surfaces 151(1) and 152(2) form an outside angle approximately equal to) 270°. As shown in FIG. 1, the outside corner angle 144 may be close to 270°, such as 271° or 273°. In this case, the deviation of the outside corner angle 144 from 270° is hardly perceptible. As a result, the outside corner benefits from the corner bead 100 with minimal, if any, impact on visual appearance.

Figure 2:
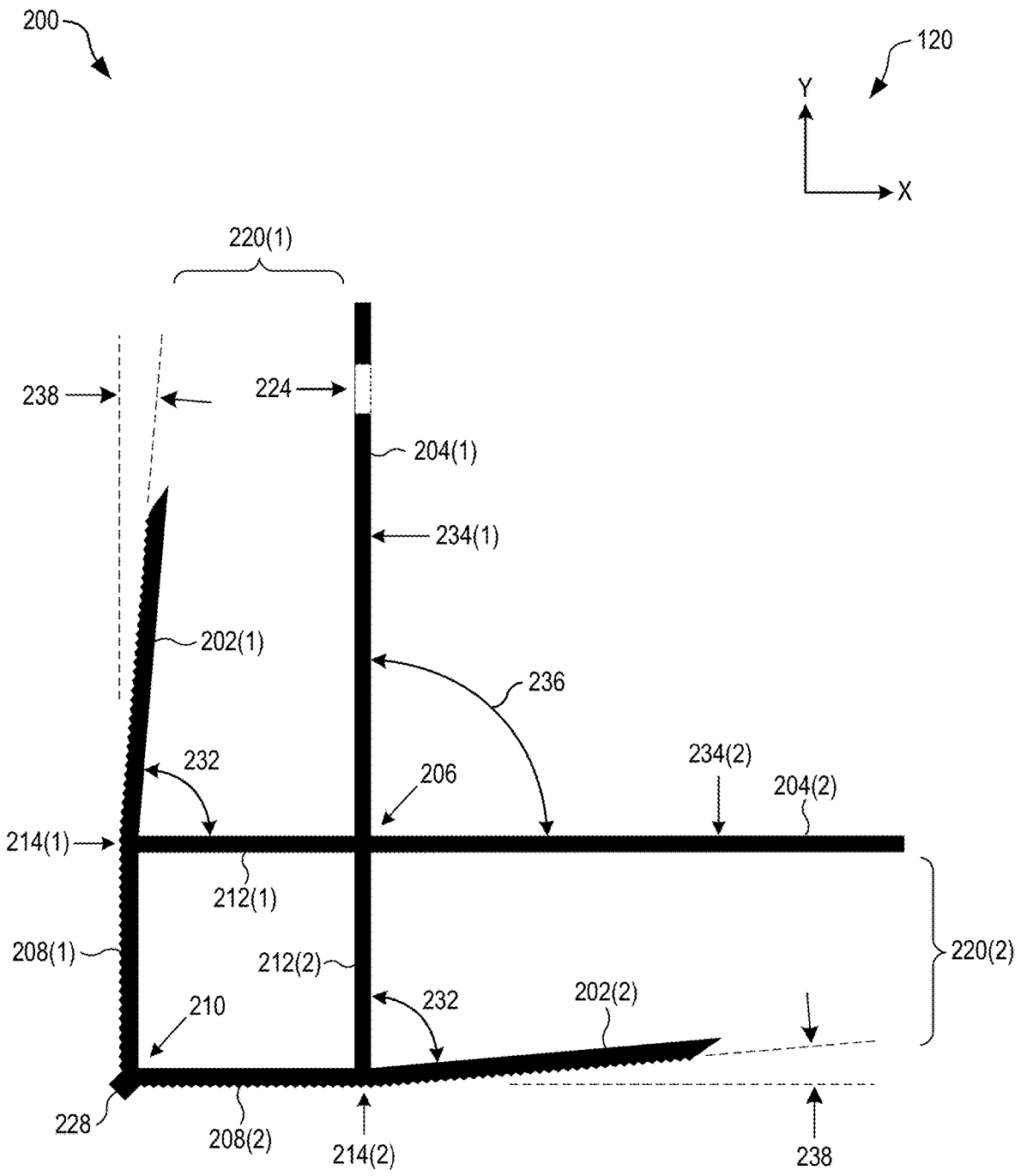
FIG. 2 is a cross-sectional view of a wallboard-fastening device that secures the first and second wallboard panels of FIG. 1 to a framing member in an outside-corner configuration without fasteners passing through the wallboard panels, in embodiments.
Figure 3:
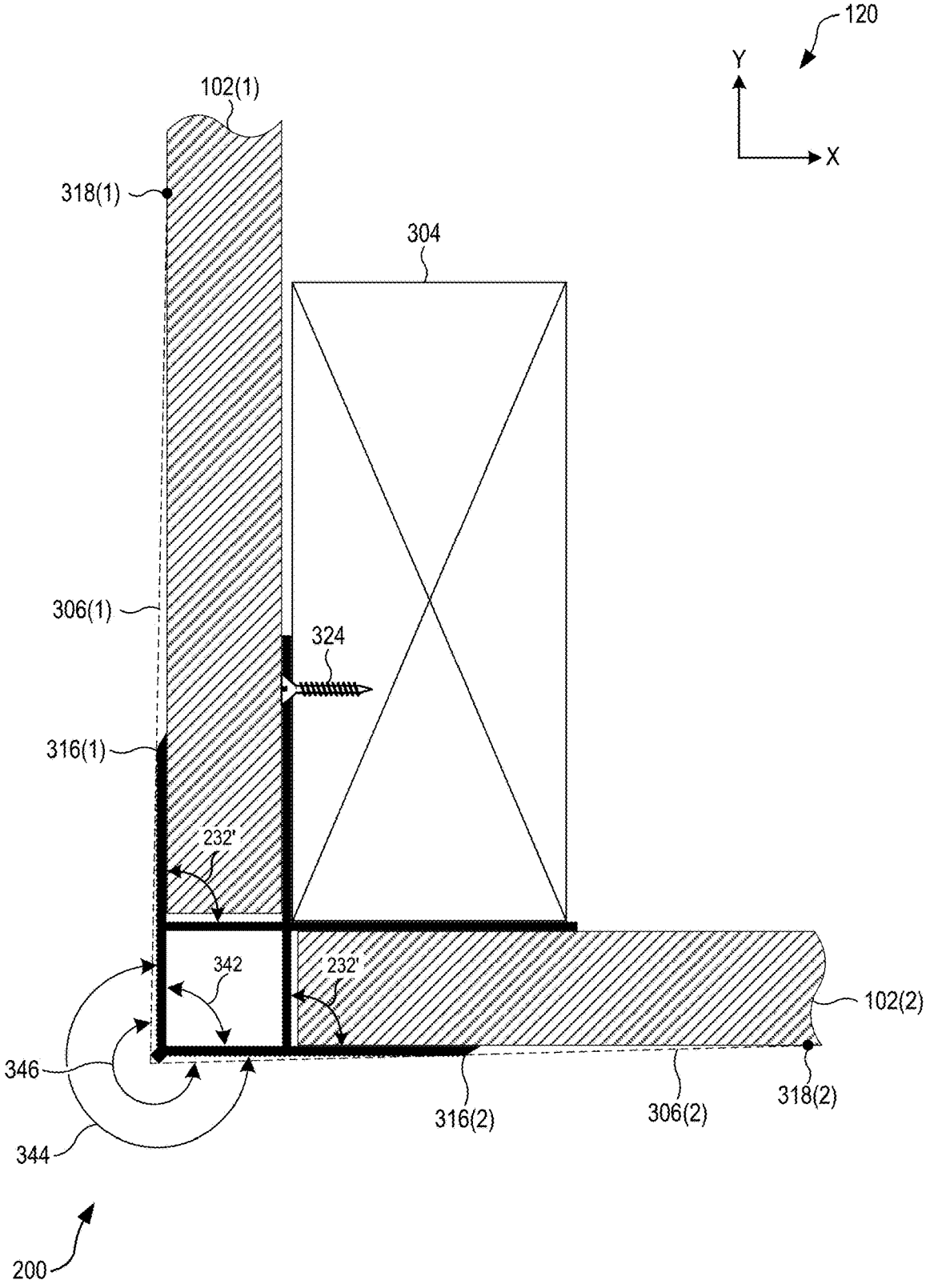
FIG. 3 illustrates the wallboard-fastening device of FIG. 2 securing the first and second wallboard panels to a wall stud in the outside-corner configuration.

FIG. 2 is a cross-sectional view of a wallboard-fastening device 200 that secures the wallboard panels 102(1) and 102(2) to a framing member in an outside-corner configuration without fasteners passing through the wallboard panels 102(1) and 102(2). FIG. 3 illustrates the wallboard-fastening device 200 of FIG. 2 securing the wallboard panels 102(1) and 102(2) to a wall stud 304 in the outside-corner configuration. FIGS. 2 and 3 are best viewed together with the following description.

The wallboard-fastening device 200 includes a first framing panel 204(1) and a second framing panel 204(2) that directly connect to each other along lengthwise edges to form an inner corner seam 206 that fits against a corner of the wall stud 304. Herein, two components connect to each other "directly" when there is no intervening component. A lengthwise edge of the first framing panel 204(1) directly connects to a lengthwise edge of the second framing panel 204(2) to form a right angle. Thus, a first inward-facing surface 234(1) of the first framing panel 204(1) and a second inward-facing surface 234(2) of the second framing panel 204(1) form an inside angle 236 of approximately 90° in the x-y plane. Herein, the term "inside" means that the surfaces 234(1) and 234(2) face the wall stud 304.

The wall stud 304 has a first stud width in the y direction and a second stud width in the x direction. FIG. 2 shows the wall stud 304 as a standard 2×4 in which the first stud width is approximately 3.5" and the second stud width is approximately 1.5". However, the present embodiments may be used with a wall stud, or another type of framing member, having different dimensions (e.g., 2×6) without departing from the scope hereof. The wall stud 304 may be constructed from wood, metal, or another material used for framing. While FIG. 3 shows the first framing panel 204(1) having a width in the y direction that is less than the first stud width, the first framing panel 204(2) may alternatively have a width that is greater than or equal to the first stud width. Similarly, while FIG. 3 shows the second framing panel 204(2) having a width in the x direction that is greater than the second stud width, the second framing panel 204(2) may alternatively have a width that is less than or equal to the second stud width.

The wallboard-fastening device 200 forms a first channel 220(1) that receives the first wallboard panel 102(1) and a second channel 220(2) that receives the second wallboard panel 102(2). The first channel 220(1) is formed from the first framing panel 204(1), a first flat-spring flange 202(1), and a first bridge panel 212(1). A first lengthwise edge of the first bridge panel 212(1) directly connects to the inner corner seam 206 while a second lengthwise edge of the first bridge panel 212(1), opposite to the first lengthwise edge, directly connects to a lengthwise edge of the first flat-spring flange 202(1) to form a first outer seam 214(1). Similarly, the second channel 220(2) is formed from the second framing panel 204(2), a second flat-spring flange 202(2), and a second bridge panel 212(2). A third lengthwise edge of the second bridge panel 212(2) directly connects to the inner corner seam 206 while a fourth lengthwise edge of the second bridge panel 212(2), opposite to the third lengthwise edge, directly connects to a lengthwise edge of the second flat-spring flange 202(2) to form a second outer seam 214(2).

A width of the first bridge panel 212(1) in the x direction may be sized according to a thickness of the first wallboard panel 102(1) (e.g., ½" or ⅝"). Similarly, a width of the second bridge panel 212(2) in the y direction may be sized according to a thickness of the second wallboard panel 102(2). In FIGS. 2 and 3, the bridge panels 212(1) and 212(2) are shown as having the same width, in which case the wallboard panels 102(1) and 102(2) have the same thickness. However, the bridge panels 212(1) and 212(2) may alternatively have different widths for when the wallboard panels 102(1) and 102(2) have different thicknesses (e.g., the first wallboard panel 102(1) has a thickness of ½" and the second wallboard panel 102(2) has a thickness of ⅝"). While FIG. 3 shows the wallboard panels 102(1) and 102(2) as being untapered, the wallboard-fastening device 200 may be alternatively configured to work with tapered wallboard panels.

The wallboard-fastening device 200 also includes a first corner panel 208(1) and a second corner panel 208(2) that directly connect to each other to form an outer corner seam 210. Specifically, the first corner panel 208(1) has first and second lengthwise edges and the second corner panel 208(2) has third and fourth lengthwise edges. The first lengthwise edge directly connects to the third lengthwise edge such that the corner panels 208(1) and 208(2) form an inside angle 342 of approximately 90°. Each of the corner panels 208(1) and 208(2) has a uniform thickness, and therefore the corner panels 208(1) and 208(2) form an outside angle 344 of 270°. Herein, the term "outside" means that the angle 344 is defined with respect to outward-facing surfaces of the corner panels 208(1) and 208(2) that face away from the wall stud 304. The second lengthwise edge directly connects to the first bridge panel 212(1) and the first flat-spring flange 202(1) at the first outer seam 214(1). Similarly, the fourth lengthwise edge directly connects to the second bridge panel 212(2) and the second flat-spring flange 202(2) at the second outer seam 214(2).

The first flat-spring flange 202(1) and first bridge panel 212(1) form a nominal angle 232 in the x-y plane that is less than 90°. For example, the nominal angle 232 may be 85°, 87°, or 89°. Equivalently, the first flat-spring flange 202(1) forms an acute angle 238 with the mathematical plane of the first corner panel 208(1), where the acute angle 238 is equal to 90° less the nominal angle 232. Thus, the first flat-spring flange 202(1) is not parallel to the first framing panel 204(1) when the first wallboard panel 102(1) is absent from (i.e., not inserted into) the first channel 220(1). Furthermore, a width of the first channel 220(1) (i.e., the distance in the x direction between the first flat-spring flange 202(1) and first framing panel 204(1)) is greatest near the first bridge panel 212(1) and decreases with increasing distance from the first bridge panel 212(1) (i.e., increasing values of y). Similar arguments hold for the second flat-spring flange 202(2), second bridge panel 212(2), and second channel 220(2).

The first flat-spring flange 202(1) may be flexed to increase the nominal angle 232, thereby opening the first channel 220(1) to facilitate insertion of the first wallboard panel 102(1) therein. After the first wallboard panel 102(1) has been inserted into the first channel 220(1), the first flat-spring flange 202(1) may be released, coming to rest forming, with the first bridge panel 212(1), a rest angle 232' of approximately 90°. In this position, the first flat-spring flange 202(1) is parallel to the first framing panel 204(1) and coplanar with the first corner panel 208(1). Similar arguments hold for the second flat-spring flange 202(2) when the second wallboard panel 102(2) is inserted into the second channel 220(2). Accordingly, the wallboard panels 102(1) and 102(2) are perpendicular to each other, as shown in FIG. 3.

The first flat-spring flange 202(1) exerts a first restoring force on the first wallboard panel 102(1) to push first wallboard panel 102(1) against the first framing panel 204(1), thereby physically securing the first wallboard panel 102(2) with respect to the wall stud 304. Similarly, the second flat-spring flange 202(2) exerts a second restoring force on the second wallboard panel 102(2) to push the second wallboard panel 102(2) against the second framing panel 204(1), thereby physically securing the second wallboard panel 102(2) with respect to the wall stud 304.

Each of the flat-spring flanges 202(1) and 202(2) may be considered a spring with a spring constant. The spring constant, and thus the magnitude of the restoring forces, is determined by the geometry of the flat-spring flanges 202(1) and 202(2) (e.g., thickness and width), the nominal angle 232, and material properties (e.g., Young's modulus) of the material forming the wallboard-fastening device 200. In the small-angle approximation and assuming that the flat-spring flanges 202(1) and 202(2) are not flexed beyond their elastic limit, the magnitude of these restoring forces scales linearly with an angular deviation from the nominal angle 232. The material may be plastic, such as PVC plastic, vinyl or another material with which the wallboard-fastening device 200 may be manufactured via extrusion. Thus, for a given material, the restoring forces may be selected by choosing an appropriate thickness of the flat-spring flanges 202(1), 202(2) and an appropriate nominal angle 232.

In FIGS. 2 and 3, the flat-spring flanges 202(1) and 202(2), corner panels 208(1) and 208(2), bridge panels 212(1) and 212(2), and framing panels 204(1) and 204(2) are shown as having the same uniform thickness. However, these panels may have different thicknesses without departing from the scope hereof. For example, in one embodiment the flat-spring flanges 202(1) and 202(2) have a thickness less than that of the panels 208(1), 208(2), 212(1), and 212(2). In another embodiment, the framing panels 204(1) and 204(2) have a thickness greater than that of the flanges 202(1), 202(2) and panels 208(1), 208(2), 212(1), and 212(2).

In the example of FIGS. 2 and 3, the first bridge panel 212(1) is coplanar with the second framing panel 204(2) and the second bridge panel 212(2) is coplanar with the first framing panel 204(1). In this case, the bridge panels 212(1), 212(2) and corner panels 208(1), 208(2) have the same width, forming a square between the seams 206 and 210. However, the first bridge panel 212(1) need not be coplanar with the second framing panel 204(2). Similarly, the second bridge panel 212(2) need not be coplanar with the first framing panel 204(1).

The wallboard-fastening device 200 also includes a nose 228 that directly connects to the outer corner seam 210. The nose 228 may be a thin strip with opposing first and second lengthwise edges. The first lengthwise edge directly connects to the outer corner seam 210 while the second lengthwise edge extends away from the outer corner seam 210. In FIGS. 2 and 3, the nose 228 forms a 135° angle with each of the corner panels 208(1) and 208(2). However, the nose 228 may alternatively form different angles with the corner panels 208(1) and 208(2). The nose 228 may have a different cross-section shape (e.g., an arc) without departing from the scope hereof.

As shown in FIG. 3, a lengthwise edge of the nose 228 extending farthest in the −x direction cooperates with a lengthwise edge 316(1) of the first flat-spring flange 202(1) to define a first plane 306(1) that intersects the outward-facing surface of the first wallboard panel 102(1) at a first intersection point 318(1). Similarly, a lengthwise edge of the nose 228 extending farthest in the −y direction cooperates with a lengthwise edge 316(2) of the second flat-spring flange 202(2) to define a second plane 306(2) that intersects the outward-facing surface of the second wallboard panel 102(2) at a second intersection point 318(2). Due to the width of the nose 228, an outside angle 346 between the planes 306(1) and 306(2) is greater than 270° (e.g., 271° or) 272° even though the wallboard panels 102(1) and 102(2) are perpendicular to each other.

Figure 4:
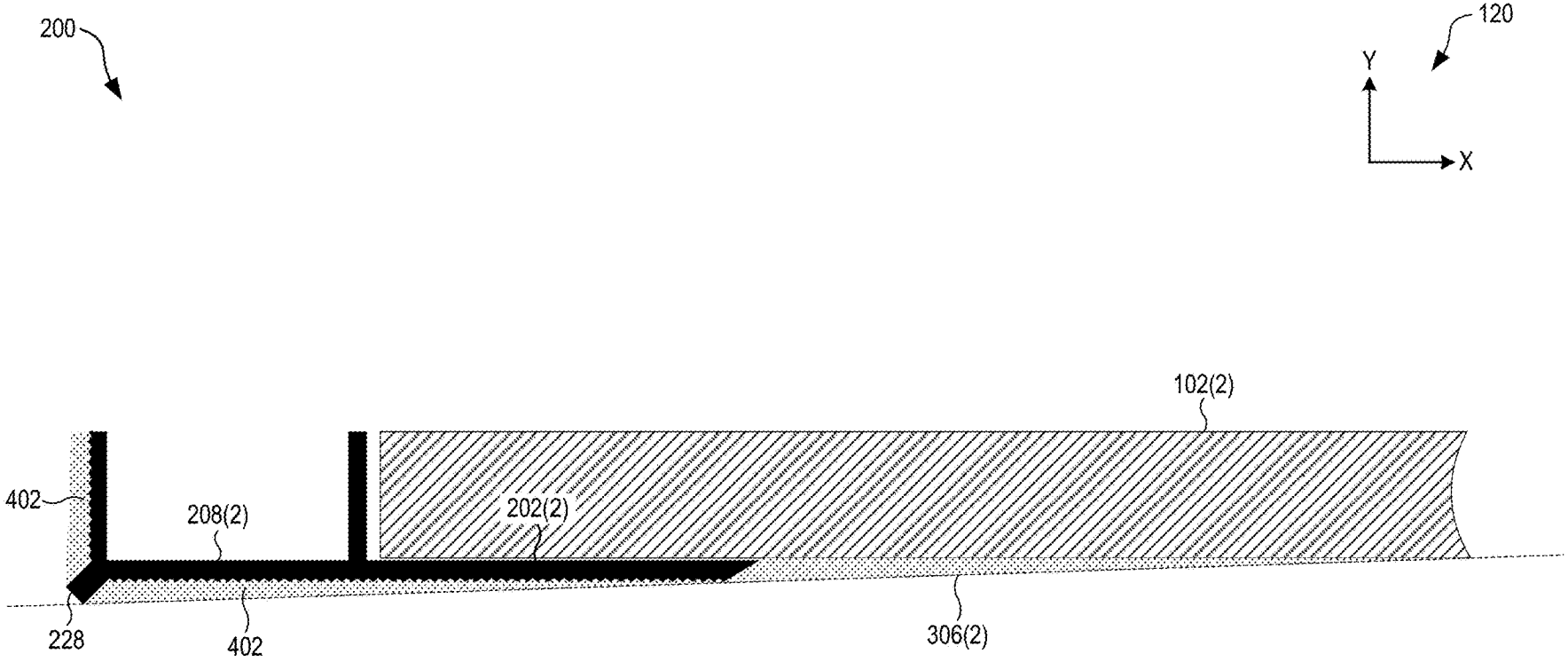
FIG. 4 shows a portion of FIG. 3 that has been expanded to more clearly show how mud may be applied to the wallboard-fastening device of FIGS. 2 and 3, in an embodiment.

FIG. 4 shows a portion of FIG. 3 that has been expanded to more clearly show how mud 402 may be applied to the wallboard-fastening device 200. Mud 402 may be applied in the region bounded by the second plane 306(2), nose 228, second corner panel 208(2), second flat-spring flange 202(2), and second wallboard panel 102(2) to create a visibly smooth surface between the nose 228 and second wallboard panel 102(2) that covers and hides the transition where the wallboard-fastening device 200 physically meets the second wallboard panel 102(2). Although not fully shown in FIG. 4, mud 402 may also be applied to the region bounded by the first plane 306(1), nose 228, first corner panel 208(1), first flat-spring flange 202(1), and first wallboard panel 102(1).

To enhance adhesion of the mud 402 to the wallboard-fastening device 200, the outward-facing surfaces of the corner panels 208(1), 208(2) and flat-spring flanges 202(1), 202(2) may be textured. For example, these outward-facing surfaces may form ridges, as shown in FIGS. 2-4. However, these outward-facing surfaces may be textured in other ways without departing from the scope hereof. Alternatively, these outward-facing surfaces may be smooth. Furthermore, one or both of flat-spring flanges 202(1) and 202(2) may form a series of lengthwise-spaced holes that reveal portions of the underlying wallboard panels 102(1) and 102(2) to which the mud 402 may adhere.

Figure 5:
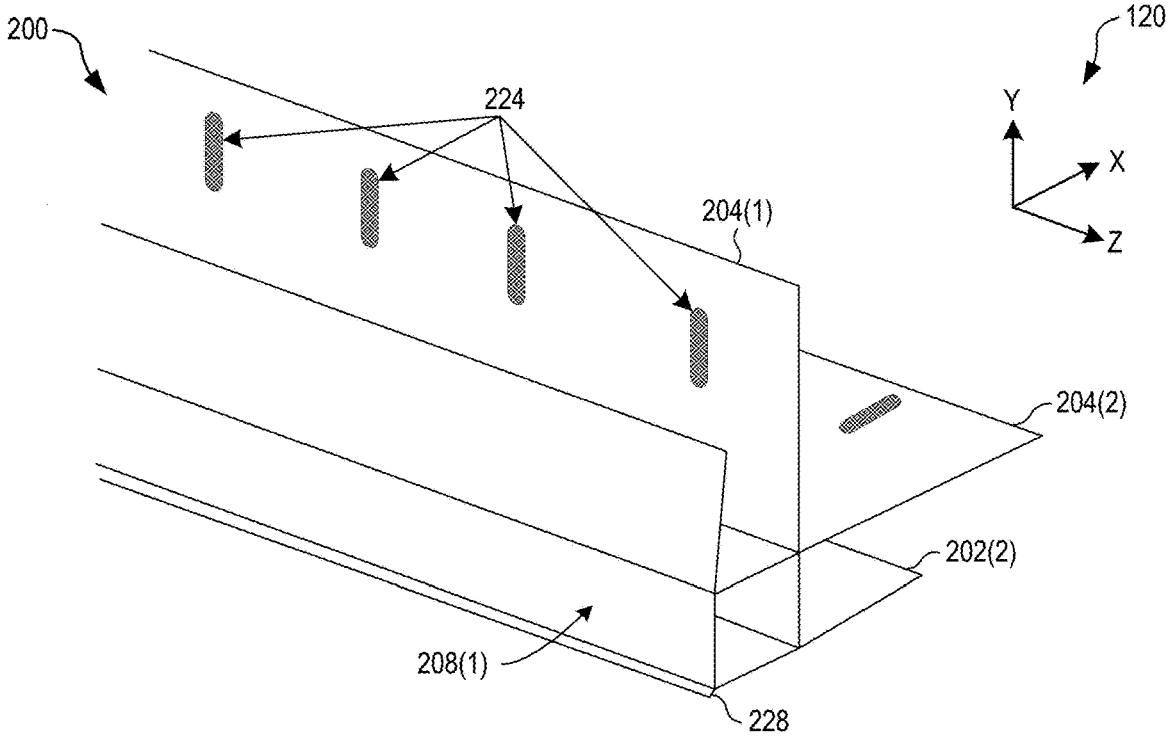
FIG. 5 is an isometric view of the wallboard-fastening device of FIGS. 2-4, showing its lengthwise extension in the z direction, in an embodiment.
Figure 6:
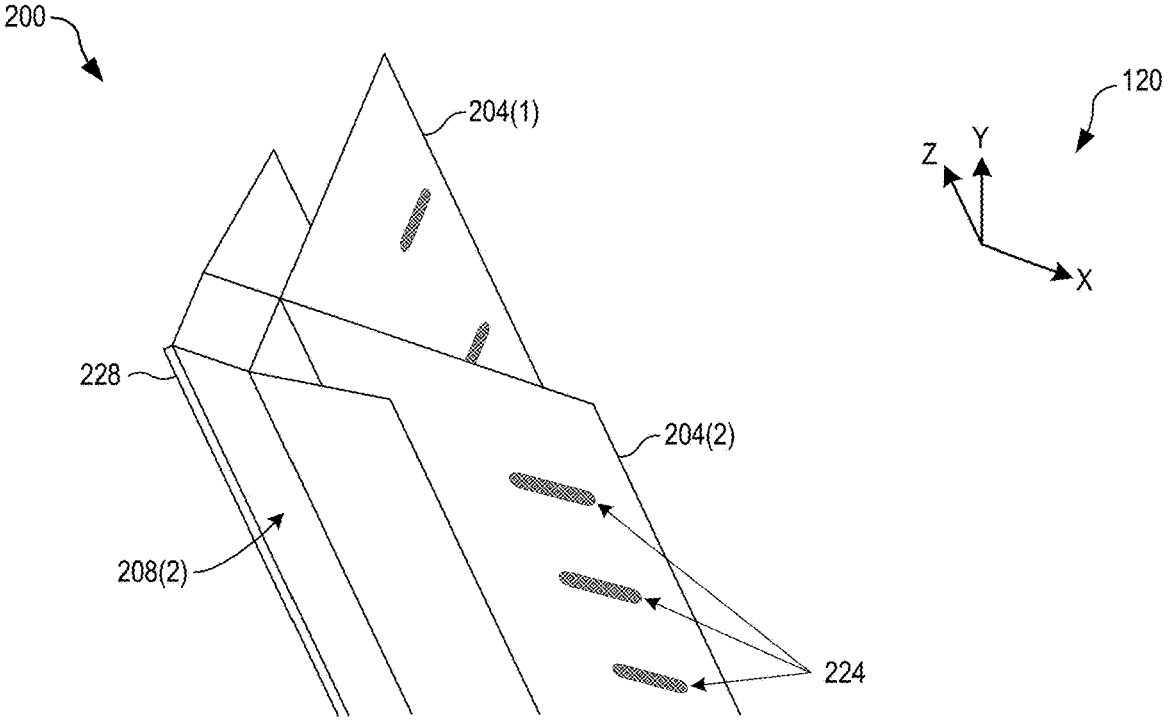
FIG. 6 is another isometric view of the wallboard-fastening device of FIGS. 2-4, in an embodiment.

FIGS. 5 and 6 are isometric views of the wallboard-fastening device 200, showing its lengthwise extension in the z direction. In FIG. 5, the first framing panel 204(1) forms one or more fastener holes 224 spaced lengthwise along the first framing panel 204(1). In FIG. 6, the second framing panel 204(2) also forms one or more fastener holes 224 spaced lengthwise along the second framing panel 204(2). Each of the fastener holes 224 may be shaped as a stadium, as shown in FIGS. 5 and 6, a circle, or another shape. FIG. 3 shows how a fastener 324 may be inserted through a fastener hole 224 to secure the first framing panel 204(1) to the wall stud 304. In some embodiments, only one of the framing panels 204(1) and 204(2) has fastener holes 224. In other embodiments, neither of the framing panels 204(1) and 204(2) has fastener holes 224. In these embodiments, the fastener 324 may be simply forced (e.g., with a drill) through one of the framing panels 204(1) and 204(2).

A length of the wallboard-fastening device 200, in the z direction, may be selected to match a corresponding length of the wallboard panels 102(1) and 102(2) (e.g., 4' or 8'). As shown in FIGS. 5 and 6, each of the flat-spring flanges 202(1) and 202(2) may be a solid uniform planar panel free from holes. The wallboard-fastening device 200 may be made of PVC, vinyl or another material that can be extruded. Although not shown in the figures, the first bridge panel 212(1) may be equipped with one or more springs that push against an end face of the first wallboard panel 102(1) to implement a control joint. The second bridge panel 212(2) may be similarly equipped with one or more springs to implement a control joint with the second wallboard panel 102(2). As an example of such springs, see v-springs 902(1) and 902(2) in FIGS. 21 and 22 of International Publication No. WO 2020/168301 A1.

Figure 7:
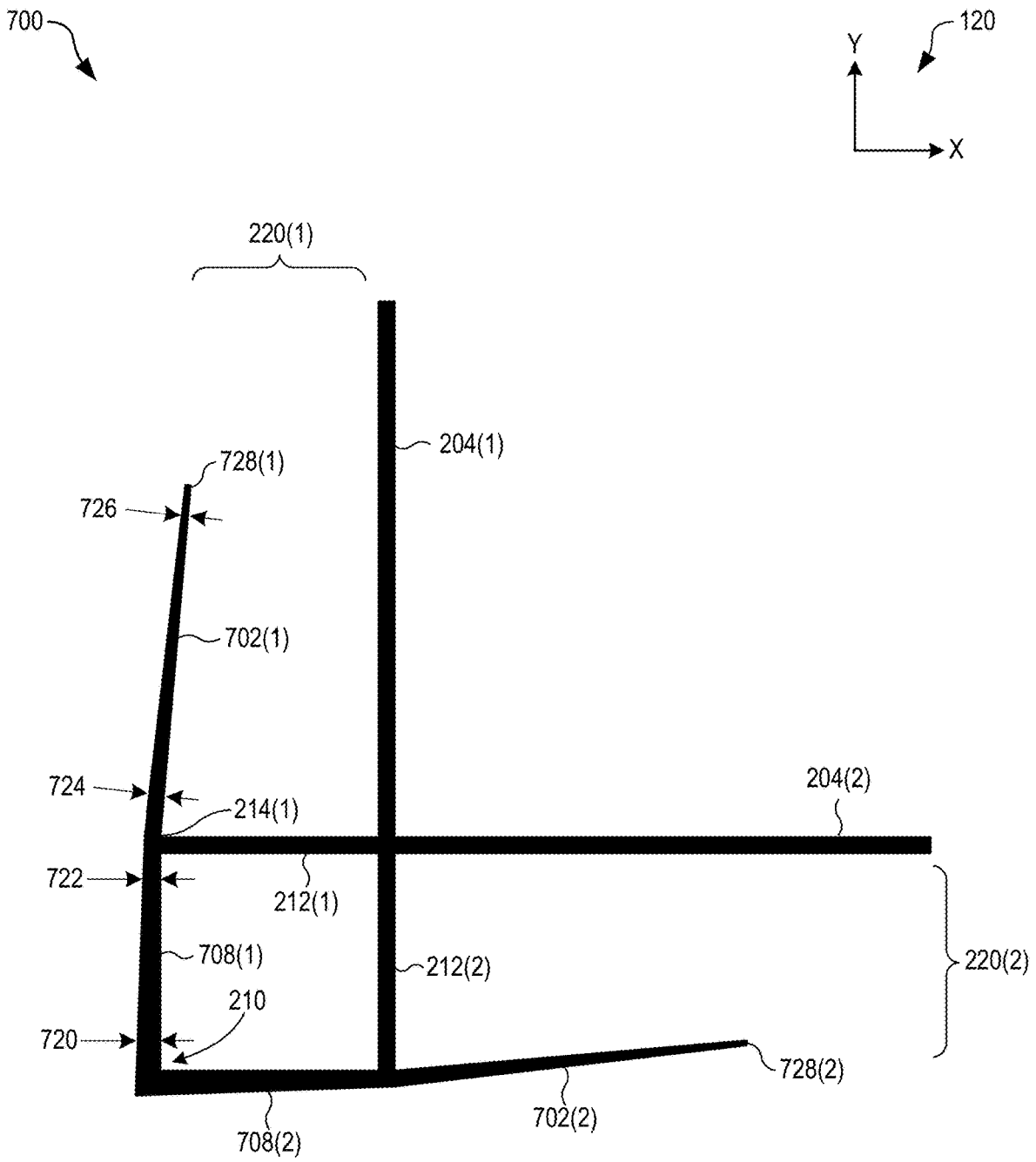
FIG. 7 is a cross-sectional view of a wallboard-fastening device that is similar to the wallboard-fastening device of FIGS. 2-6 except that it uses tapered corner panels instead of a nose, in an embodiment.

FIG. 7 is a cross-sectional view of a wallboard-fastening device 700 that is similar to the wallboard-fastening device 200 of FIGS. 2-6 except that it uses a first tapered corner panel 708(1) and a second tapered corner panel 708(2) instead of the nose 228. The wallboard-fastening device 700 also includes a first tapered flat-spring flange 702(1) and a second tapered flat-spring flange 702(2). Each of the flat-spring flanges 702(1), 702(2) and corner panels 708(1), 708(2) is "tapered" in that its thickness decreases with increasing distance from the outer corner seam 210. Thus, in FIG. 7 the first tapered corner panel 708(1) has a first thickness 720 in the x direction that is greatest near the outer corner seam 210. Near the first outer seam 214(1), the first tapered corner panel 708(1) has a second thickness 722 that is less than the first thickness 720. Similarly, the first tapered flat-spring flange 702(1) has a third thickness 724 that is greatest near the first outer seam 214(1). Near a first distal edge 728(1), the first tapered flat-spring flange 702(1) has a fourth thickness 726 that is less than the third thickness 724. For clarity in FIG. 7, the thicknesses 720, 722, 724, and 726 are not indicated for the second tapered flat-spring flange 702(2) and the second tapered corner panel 708(2).

The third thickness 724 may be less than the second thickness 722. In this case, all thicknesses of the first tapered flat-spring flange 702(1) are less than all thicknesses of the first tapered corner panel 708(1). In some embodiments, the thickness of the first tapered corner panel 708(1) decreases linearly along a first width direction of the first tapered corner panel 708(1). In FIG. 7, this first width direction is the +y direction. Similarly, the thickness of the second tapered corner panel 708(2) decreases linearly along a second width direction of the second tapered corner panel 708(2). In FIG. 7, this second width direction is the +x direction. The thicknesses of the tapered flat-spring flanges 702(1) and 702(2) may similarly decrease linearly along their respective width directions.

Figure 8:
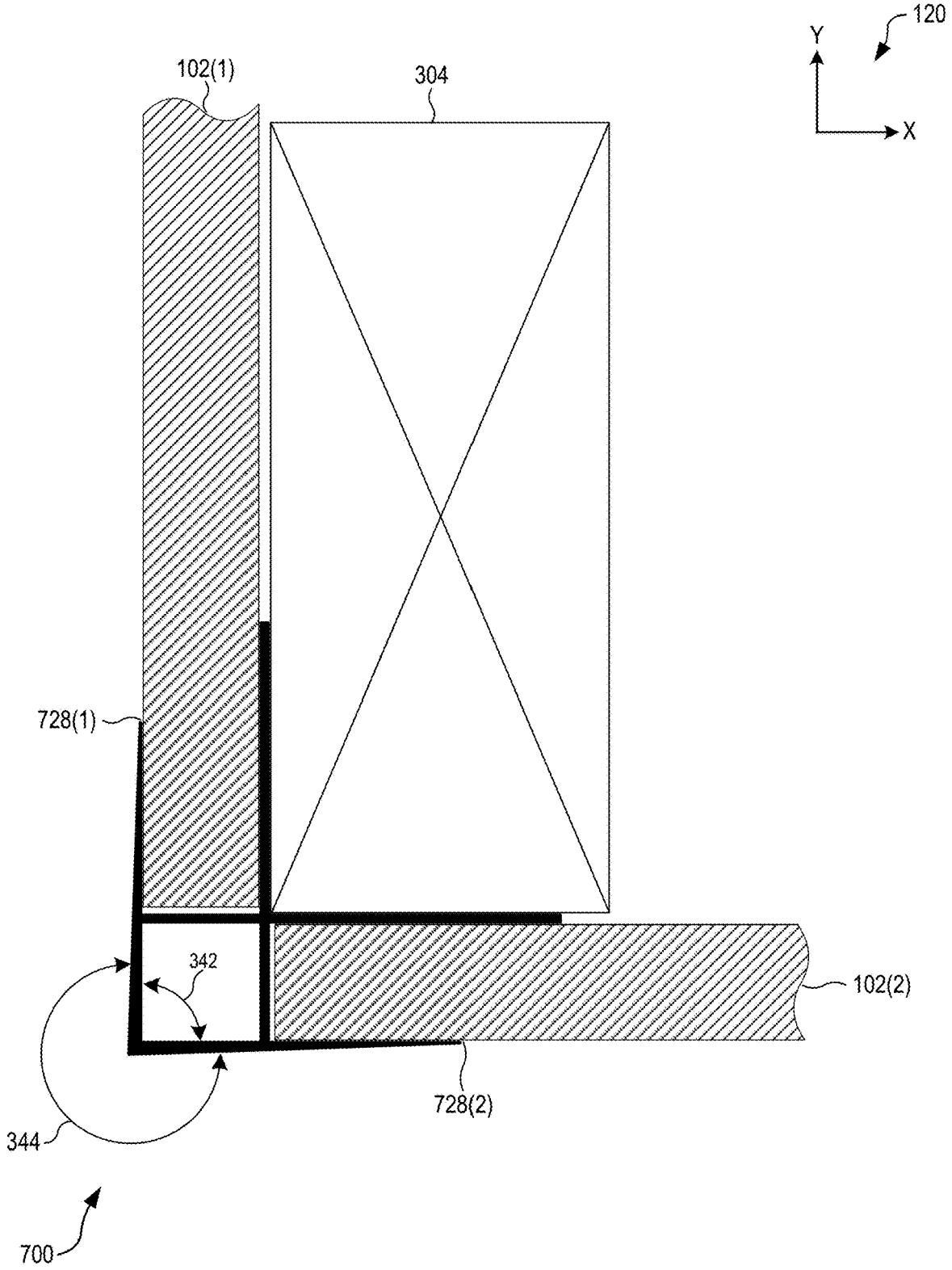
FIG. 8 illustrates the wallboard-fastening device of FIG. 7 securing the first and second wallboards to the wall stud in the outside-corner configuration.

FIG. 8 illustrates the wallboard-fastening device 700 of FIG. 7 securing the wallboard panels 102(1) and 102(2) to the wall stud 304 in the outside-corner configuration. After the first wallboard panel 102(1) has been inserted into the first channel 220(1), the outward-facing surfaces of the corner panel 708(1) and flat-spring flange 702(1) are coplanar, thereby providing a continuously, smooth, flat surface between the outer corner seam 210 and the first distal edge 728(1). While FIG. 8 shows the inward-facing surfaces of the corner panel 708(1) and flat-spring flange 702(1) as also being co-planar, the thicknesses of the corner panel 708(1) and flat-spring flange 702(1) may be selected such that these inward-facing surfaces are not co-planar while the outward-facing surfaces are co-planar. Similar arguments apply to the corner panel 708(2) and flat-spring flange 702(2) when the second wallboard panel 102(2) is inserted into the second channel 220(2).

The outward-facing surfaces of the tapered corner panels 708(1) and 708(2) form the outside angle 344, which is greater than 270°. Thus, these outward-facing surfaces correspond to the planes 306(1) and 306(2) in FIGS. 3 and 4. When the outward-facing surfaces of the tapered corner panel 708(1) and tapered flat-spring flange 702(1) are co-planar with each other, and the outward-facing surfaces of the tapered corner panel 708(2) and tapered flat-spring flange 702(2) are co-planar with each other, then the outward-facing surfaces of the tapered flat-spring flanges 702(1) and 702(2) also form the outside angle 344. The inward-facing surfaces of the tapered corner panels 708(1) and 708(2) form the inside angle 342, which is approximately 90°.

Figure 9:
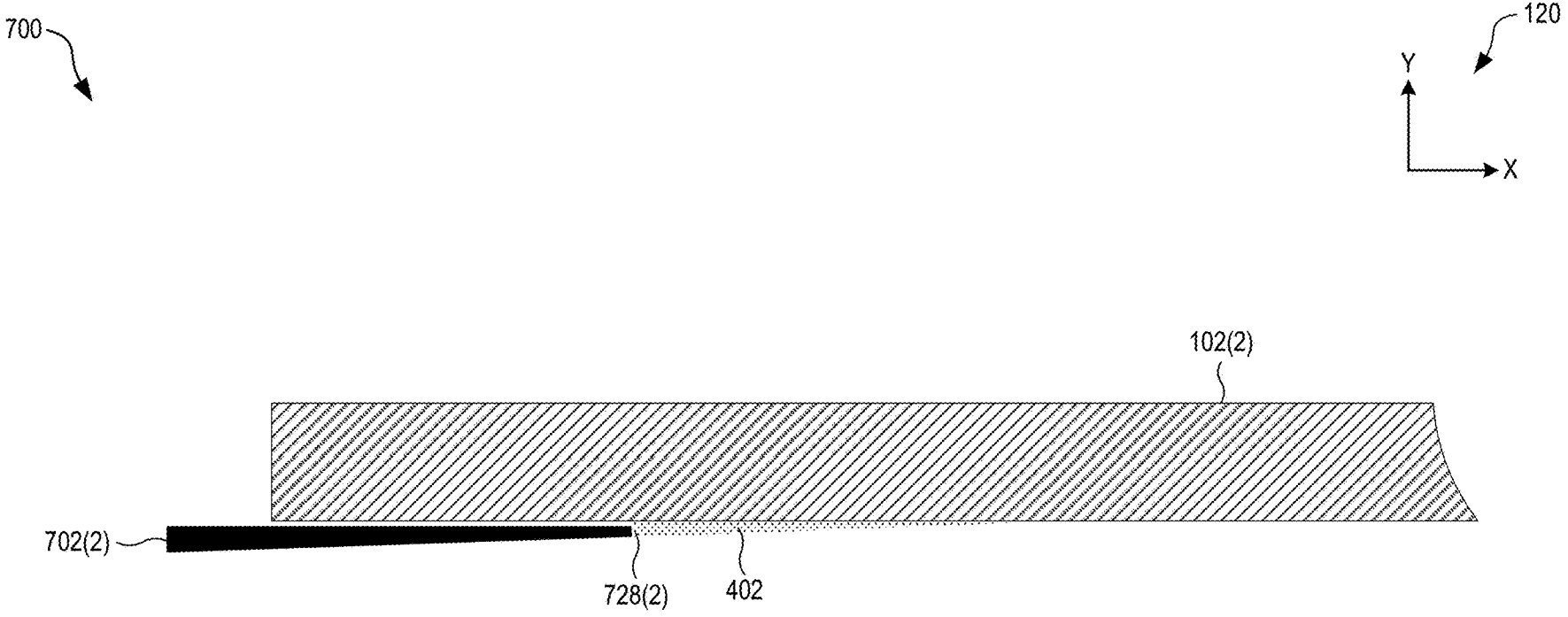
FIG. 9 shows a portion of FIG. 8 that has been expanded to more clearly show how mud may be applied to the wallboard-fastening device of FIG. 7, in an embodiment.

FIG. 9 shows a portion of FIG. 8 that has been expanded to more clearly show how mud 402 may be applied to the wallboard-fastening device 700. Only a small amount of mud 402 is needed to cover the seam formed where the second distal edge 728(2) meets the outward-facing surface of the second wallboard panel 102(2). Although not shown in FIG. 9, mud 402 may be similarly applied to cover the seam formed where the first distal edge 728(1) meets the outward-facing surface of the first wallboard panel 102(1). Thus, one advantage of the wallboard-fastening device 700, as compared to the wallboard-fastening device 200 of FIGS. 2-6, is that less mud 402 is needed create a visibly smooth outward-facing surface that hides the transitions between the wallboard-fastening device 700 and the wallboard panels 102(1) and 102(2). Using less mud 402 speeds up installation and reduces the likelihood of installation errors. Less mud 402 also means that fewer cracks can develop, which will help to preserve the uniformity and smoothness of the visible surface over time.

Another advantage of the wallboard-fastening device 700 is that the tapered corner panels 708(1) and 708(2) are thicker near the outer corner seam 210, as compared to the untapered (i.e., having uniform thickness) corner panels 208(1) and 208(2) shown in FIGS. 2 and 3. This added thickness may provide greater mechanical strength than the nose 228. Accordingly, the wallboard-fastening device 700 may be more resilient to physical impact at the outer corner seam 210.

Since no mud 402 covers the tapered corner panels 708(1), 708(2) and little, if any, mud 402 covers the tapered flat-spring flanges 702(1), 702(2), FIGS. 7-9 show the tapered corner panels 708(1), 708(2) and tapered flat-spring flanges 702(1), 702(2) as having outward-facing surfaces that are smooth, i.e., not textured. However, any one or more of the tapered corner panels 708(1), 708(2) and tapered flat-spring flanges 702(1), 702(2) may have outward-facing surfaces that are textured without departing from the scope hereof.

Figure 10:
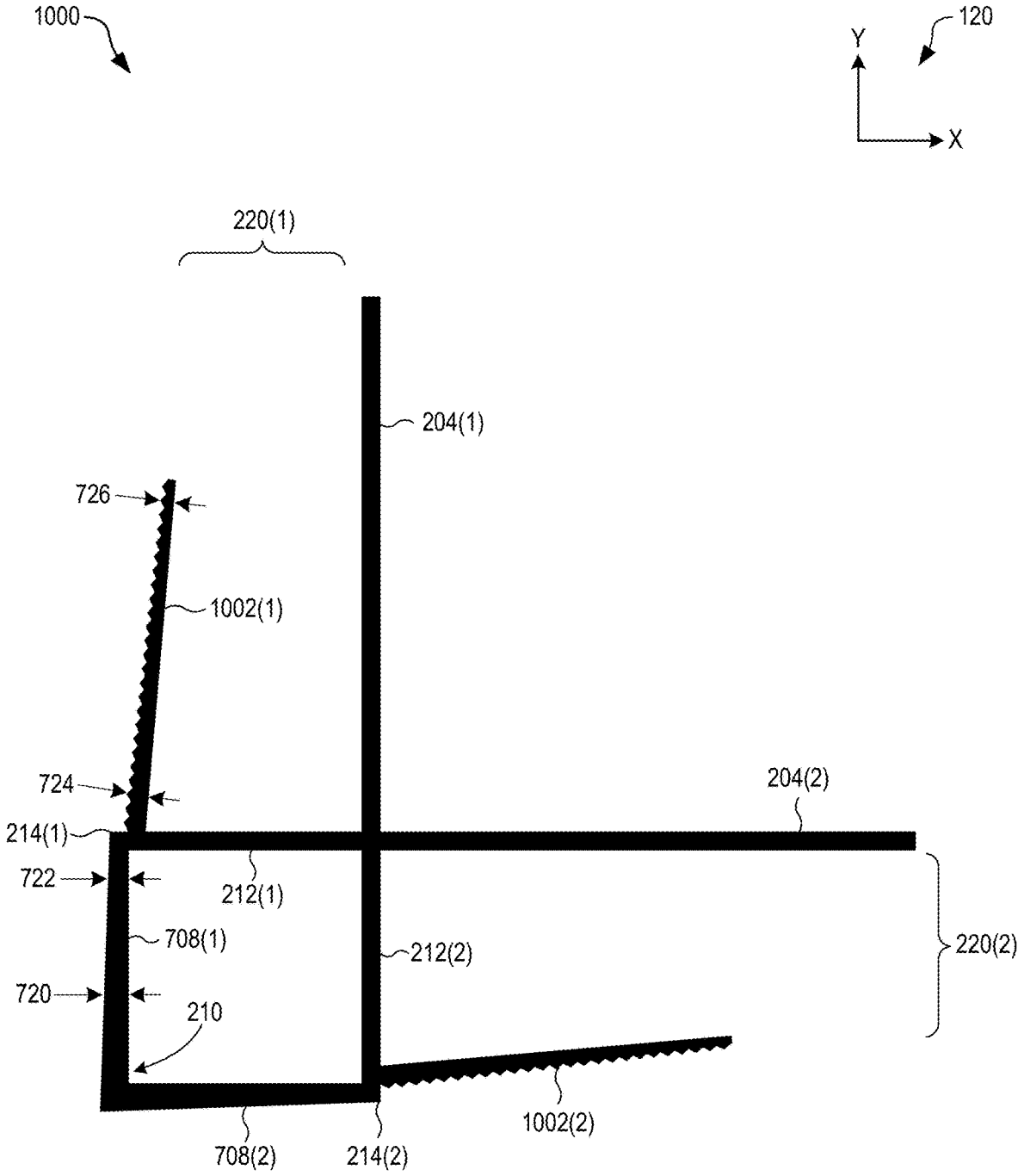
FIG. 10 is a cross-sectional view of a wallboard-fastening device that is similar to the wallboard-fastening device of FIGS. 7-9, in an embodiment.

FIG. 10 is a cross-sectional view of a wallboard-fastening device 1000 that is similar to the wallboard-fastening device 700 of FIGS. 7-9 except that it uses a first flat-spring flange 1002(1) that does not directly connect to the first outer seam 214(1) and a second flat-spring flange 1002(2) that does not directly connect to the second outer seam 214(1). Rather, a lengthwise edge of the first flat-spring flange 1002(1) directly connects to the first bridge panel 212(1) away from the first outer seam 214(1). Due to this connection, a first step is formed between the outward-facing surfaces of the tapered corner panel 708(1) and the flat-spring flange 1002(1) (see first step 1102(1) in FIG. 11). Similarly, a second step is formed between the outward-facing surfaces of the tapered corner panel 708(2) and the flat-spring flange 1002(2) (see second step 1102(2) in FIG. 11). In FIG. 10, each of the flat-spring flanges 1002(1) and 1002(2) is tapered like the flat-spring flanges 702(1) and 702(2) of FIGS. 7-9. However, each of the flat-spring flanges 1002(1) and 1002(2) may alternatively have a uniform thickness like the flat-spring flanges 202(1) and 202(2) of FIGS. 2-6.

Figure 11:
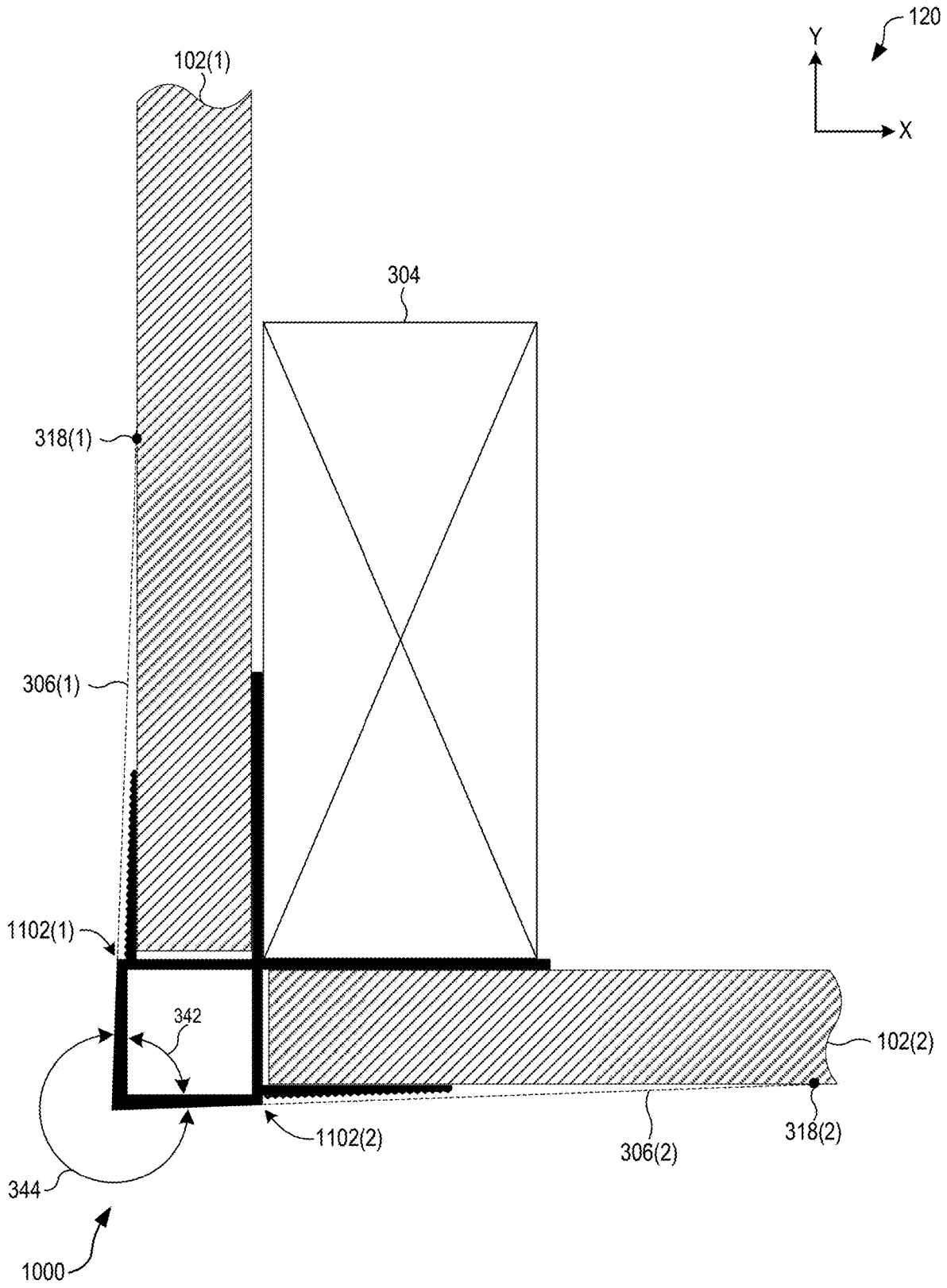
FIG. 11 illustrates the wallboard-fastening device of FIG. 10 securing the first and second wallboards to the wall stud in the outside-corner configuration.

FIG. 11 illustrates the wallboard-fastening device 1000 of FIG. 10 securing the wallboard panels 102(1) and 102(2) to the wall stud 304 in the outside-corner configuration. Due to the first step 1102(1), the outward-facing surfaces of the tapered corner panel 708(1) and the flat-spring flange 1002(1) are not co-planar with each other. Similarly, the second step 1102(2) causes the outward-facing surfaces of the tapered corner panel 708(2) and the flat-spring flange 1002(2) to not be co-planar with each other. FIG. 11 also shows the first plane 306(1), which coincides with the outward-facing surface of the first tapered corner panel 708(1) and intersects the first wallboard panel 102(1) at the first intersection point 318(1). Similarly, FIG. 11 shows the second plane 306(2), which coincides with the outward-facing surface of the second tapered corner panel 708(2) and intersects the second wallboard panel 102(2) at the second intersection point 318(2).

Figure 12:
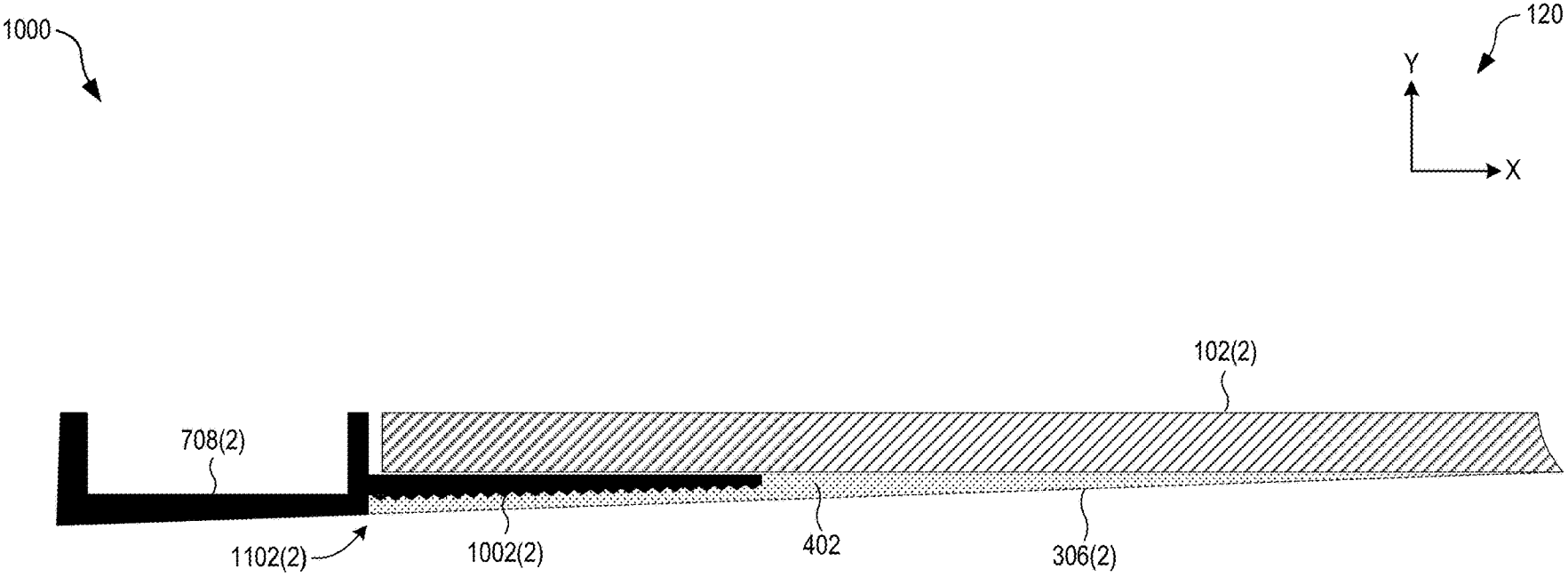
FIG. 12 shows a portion of FIG. 11 that has been expanded to more clearly show how mud may be applied to the wallboard-fastening device of FIGS. 11 and 12, in an embodiment.

FIG. 12 shows a portion of FIG. 11 that has been expanded to more clearly show how mud 402 may be applied to the wallboard-fastening device 1000. Mud 402 may be applied and finished in the region bounded by the second plane 306(2), second step 1102(2), second flat-spring flange 1002(2), and second wallboard panel 102(2) to create a visibly smooth surface between the second step 1102(2) and second wallboard panel 102(2). The mud 402 covers and hides the seam where the wallboard-fastening device 1000 meets the outward-facing surface of the second wallboard panel 102(2). Although not shown in FIG. 12, mud 402 may be similarly applied to cover the seam between the first flat-spring flange 1002(1) and the outward-facing surface of the first wallboard panel 102(1).

Advantageously, little if any mud 402 need be applied over the tapered corner panels 708(1) and 708(2). Accordingly, the wallboard-fastening device 1000 uses less mud 402 than the wallboard-fastening device 200 of FIGS. 2-6. However, mud 402 may be applied over the flat-spring flanges 1002(1) and 1002(2). For this reason, the outward-facing surfaces of the flat-spring flanges 1002(1) and 1002(2) are shown in FIGS. 10-12 as being textured to enhance adhesion of the mud 402. However, the outward-facing surfaces of the flat-spring flanges 1002(1) and 1002(2) may alternatively be smooth.

Test Results

As described above, the present embodiments may be used with similar wallboard-mounting devices for butt joints and inside-corner joints to create a complete wallboard installation system. To test the effectiveness of this system at sound isolation, a sound transmission loss test was performed in accordance with ASTM E90-09 (2016), ASTM E413-16, ASTM E1332-16, and ASTM E2235-04 (2020). The tested specimen created a three butt joints from five pieces of ⅝"-thick gypsum board (National Gypsum Type X). The butt joints were created using wallboard-fastening devices similar to that shown in FIGS. 1 and 2 of International Publication No. WO 2020/168301 A1.

The specimen was installed inside a rectangular-shaped test opening of a filler wall that separated a receive room (volume of 234 $m^3$) from a source room (volume of 207 $m^3$) inside a test chamber. The test opening had a height of approximately 96". Running horizontally along the top and bottom edges of the test opening were 25-gauge steel tracks. These tracks were affixed to the test opening using screws and isolation washers. To further isolate the tracks from the filler wall, ⅜" Neoprene gaskets were adhered to these tracks.

Five 25-gauge steel studs (each having dimensions of 1.25"×3.625"×96") were installed to the steel tracks and positioned with 24" center-to-center horizontal spacing. The tested wallboard-fastening devices were made of extruded PVC. One 96"-long wallboard-fastening device was fastened with screws to each of the first, third, and fifth studs. The distance from the left edge of the test opening to the first wallboard-fastening device was approximately 3.25". The distance between the first and second wallboard-fastening devices was approximately 48". The distance between the second and third wallboard-fastening devices was also approximately 48". The distance between the third wallboard-fastening device and the right edge of the test opening was approximately 3.25".

After the five pieces of gypsum board were installed on the source-room side of the test specimen, four batts of R-13 fiberglass insulation were installed behind the gypsum boards. To finish the test specimen on the receive-rom side, the arrangement was repeated with three additional wallboard-fastening devices and five additional pieces of gypsum board. Aluminum foil tape was used to seal the gypsum board against the wallboard-fastening devices. Duct tape was used to seal the gypsum boards along their top and bottom edges. After installation, the receive-room side of the test specimen was approximately ¼" from being flush with the receive-room face of the filler wall. A stethoscope was used to check for any abnormal air leaks around the test specimen prior to testing.

Figure 13:
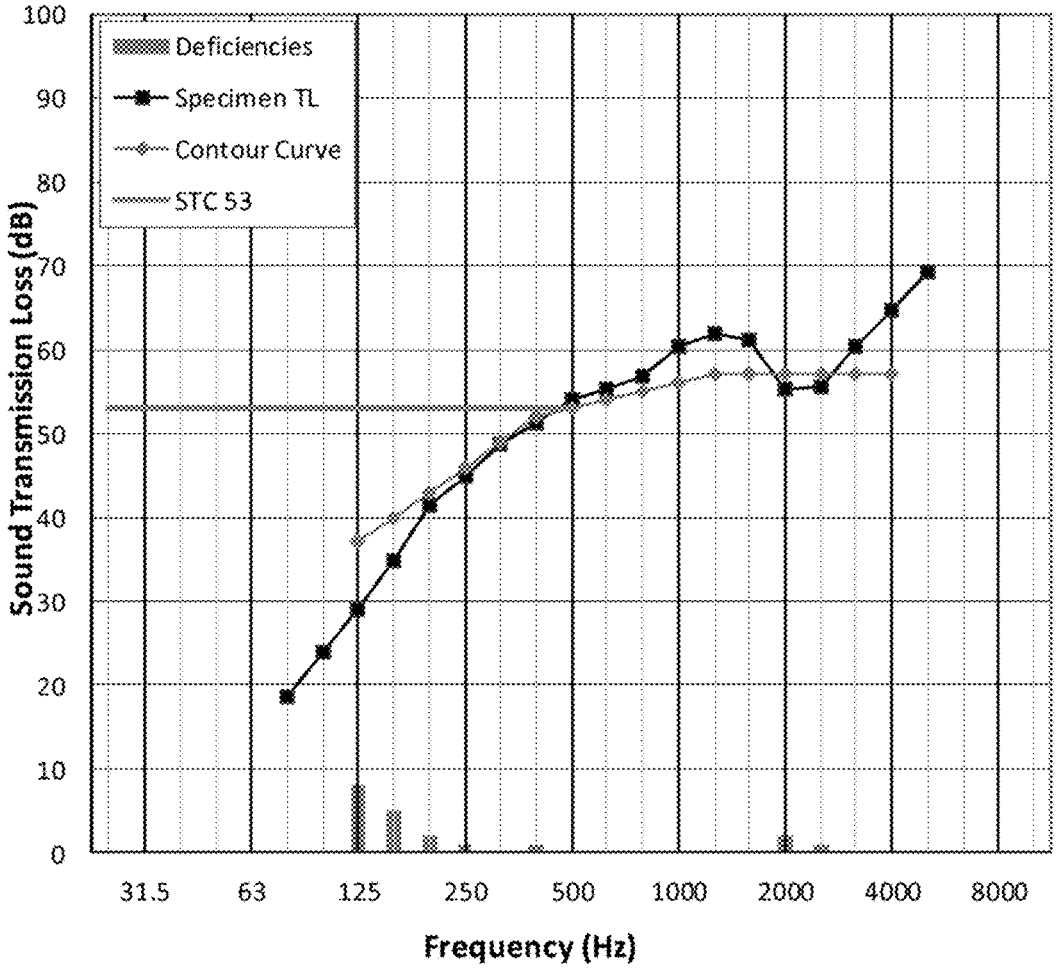
FIG. 13 is a plot of airborne sound transmission loss.

FIG. 13 is a plot of airborne sound transmission loss that was obtained from the test measurements. The sound transmission class (STC) rating is 53. The sum of deficiencies is 20. The Outdoor-Indoor Transmission Class (OITC) rating is 36. For comparison, a similar single-wall configuration using wood 2×4 studs and prior-art installation and finishing techniques typically results in an STC rating of 43. An STC rating of 60, or higher, requires a double-wall configuration, significant quantities of sound dampening materials (e.g., mass-loaded vinyl), or both.

While the sound transmission loss test was performed with butt joints, it is believed that the high sound isolation is due to the fact that the gypsum boards have no screws passing through them. Therefore, comparable results are expected for corner joints, including outside-corner joints that are formed with the present embodiments. Therefore, a wallboard installation system using the present embodiments can serve as an alternative to prior-art resilient channel systems that is advantageously easier to install.

To determine the strength of these wallboard installation systems, a traverse-load test was performed in accordance with ASTM E72 (Section 11) per ICC-ES AC271. Test specimens were constructed from two pieces of ⅝"-thick type-X drywall (Exacor™ sheathing), each measuring 24"×96". A butt joint was created from these two pieces of drywall using a 96"-long wallboard-fastening device like that shown in FIGS. 1 and 2 of International Publication No. WO 2020/168301 A1. Affixed to each of the two remaining 96"-long edges of the drywall pieces was a 96"-long outside-corner wallboard-fastening device similar to that shown in FIGS. 13 and 14 of International Publication No. WO 2020/16830 (except with the third framing panel 1320). The wallboard-fastening devices were made from extruded PVC and were affixed to underlying studs (Clark Dietrich ProSTUD® 25 ga. EQ×3⅝" Web×1¼" Flange) using #18-8¾"-length self-drilling screws spaced 18" apart. Ends of the studs were affixed to a top plate and a bottom plate (Clark Dietrich ProTRAK® 25 ga. EQ×3⅝" Web×1¼ Flange) using #18-8½"-length self-drilling screws. The studs were spaced 24" apart (center-to-center).

Three specimens (numbered 1-3) were used for positive pressure testing. An additional three specimens (numbered 4-6) were used for negative pressure testing. For comparison, an additional specimen (numbered 7) was constructed using commercially available resilient channel (Clark Dietrich RC-1 Pro™ 25 ga.×2-in.×½-in. deep with 1¼-in. flange).

The test setup consisted of a vacuum chamber with an open side slightly larger than the test specimens. A vacuum pump and manometer connection provided a means to apply and monitor the applied pressure. Each specimen was placed in the test setup in the desired orientation. Polyethylene sheeting was placed to provide the specified positive or negative load. The polyethylene sheathing was pleated to accommodate sample deflection and was sealed to the vacuum chamber. The manner in which the polyethylene sheathing was used did not influence the outcome of the test.

Instrumentation included a water manometer and dial indicators. The dial indicators had a resolution of 0.001 inches. One dial indicator was placed at the center of the specimen. A second dial indicator was placed along the edge of the specimen. A third dial indicator was placed half-way between the first and second dial indicators.

Each specimen was loaded in ¼ live load increments. At each stage, deflection readings were taken immediately upon reaching the target load and again after five minutes of continued load application. The applied load was then removed and the specimen was allowed to recover. During the recovery period, dial gauge readings were taken immediately upon removing the load and again after five minutes has elapsed. The loading and unloading cycles were continued as specified. Once the deflection measurement loading stages were completed, the deflection gauges were removed, and the load was increased to ultimate. At ultimate, the mode of failure and ultimate load were recorded. At any time during the test, when the behavior of the specimen under load indicated that sudden failure may occur the dial indicators may have been removed.

The following table summarizes the test results:

| Specimen | Pressure Orientation | Ultimate Pressure (psf) | Average Deflection at 5 psf (in.) | Failure Mode |
|---|---|---|---|---|
| 1 | Negative | 34 | 0.028 | Buckling failure of the |
| 2 | | 28 | 0.019 | studs at or near |
| 3 | | 33 | 0.022 | midspan of assembly |
| 4 | Positive | 45 | 0.010 | Buckling failure of the |
| 5 | | 46 | 0.012 | studs approximately 38 |
| 6 | | 50 | 0.032 | in. from bottom of panel |
| 7 | Negative | 24 | 0.104 | Buckling failure of the studs at midspan of the assembly |

For negative pressure, the average ultimate pressure of specimens 1-3 is 32. For pressure, the average ultimate pressure of specimens 4-6 is 47 psf. By comparison, the prior-art system of specimen 7 only achieved an ultimate pressure of 24 (for negative pressure orientation).

During these tests, specimens 1-6 never failed, i.e., the wallboard panels remained secured. Instead, the testing was limited by buckling of the 25-gauge-steel studs. With sturdier studs, an average ultimate pressure in excess of 40 (for negative pressure orientations) can be reasonably expected. Accordingly, the present embodiments can be used to create wallboard installations that are at least 50% stronger than those using prior-art resilient channel.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

The invention claimed is:

1. A wallboard-fastening device for securing first and second wallboards to a framing member in an outside-corner configuration, comprising:

first and second framing panels joined lengthwise to each other to form an inner corner configured to fit against a corner of the framing member;

first and second corner panels joined lengthwise to each other such that an outside angle between the first and second corner panels is greater than 270°;

a first bridge panel joined lengthwise to the first corner panel and the inner corner;

a second bridge panel joined lengthwise to the second corner panel and the inner corner;

a first flat-spring flange joined lengthwise to the first bridge panel such that the first flat-spring flange, the first bridge panel, and the first framing panel form a first channel sized to accept the first wallboard, the first flat-spring flange forming a first step with the first corner panel, the first flat-spring flange having an outward-facing surface that forms ridges to receive joint compound up to the first step; and a second flat-spring flange joined lengthwise to the second bridge panel such that the second flat-spring flange, the second bridge panel, and the second framing panel form a second channel sized to accept the second wallboard, the second flat-spring flange forming a second step with the second corner panel, the second flat-spring flange having an outward-facing surface that forms ridges to receive joint compound up to the second step;

wherein:

the first flat-spring flange is configured to flex, when the first wallboard is inserted into the first channel, such that the first flat-spring flange pushes the first wallboard against the first framing panel; and the second flat-spring flange is configured to flex, when the second wallboard is inserted into the second channel, such that the second flat-spring flange pushes the second wallboard against the second framing panel.

2. The wallboard-fastening device of claim 1, the first and second corner panels forming an inside angle of 90°.

3. The wallboard-fastening device of claim 1, the first and second corner panels being tapered.

4. The wallboard-fastening device of claim 1, each of the first and second corner panels having an outward-facing surface that is textured to receive joint compound.

5. The wallboard-fastening device of claim 1, wherein:

the first corner panel has first and second lengthwise edges;

the second corner panel has third and fourth lengthwise edges;

the first lengthwise edge directly connects to the third lengthwise edge;

the second lengthwise edge directly connects to the first bridge panel; and the fourth lengthwise edge directly connects to the second bridge panel.

6. The wallboard-fastening device of claim 1, wherein:

the first bridge panel is coplanar with the second framing panel;

the second bridge panel is coplanar with the first framing panel;

the first flat-spring flange forms, when the first wallboard is absent from the first channel, a first angle with the first bridge panel that is less than 90°; and the second flat-spring flange forms, when the second wallboard is absent from the second channel, a second angle with the second bridge panel that is less than 90°.

7. The wallboard-fastening device of claim 1, wherein the first and second wallboards, when inserted into the respective first and second channels, are perpendicular to each other.

8. The wallboard-fastening device of claim 1, wherein:

a width of the first flat-spring flange is less than a width of the first framing panel; and a width of the second flat-spring flange is less than a width of the second framing panel.

9. The wallboard-fastening device of claim 1, one or both of the first and second framing panels form a plurality of fastener holes spaced lengthwise along said one or both of the first and second framing panels.

10. The wallboard-fastening device of claim 1, the first framing panel, the second framing panel, the first bridge panel, and the second bridge panel having the same uniform thickness.

11. The wallboard-fastening device of claim 1, wherein:

the first framing panel has a first lengthwise edge;

the second framing panel has a second lengthwise edge; and the first lengthwise edge directly connects to the second lengthwise edge such that the first and second framing panels form an inside angle of 90°.

12. The wallboard-fastening device of claim 10, the first framing panel, the second framing panel, the first bridge panel, the second bridge panel, the first corner panel, and the second corner panel having the same uniform thickness.

13. The wallboard-fastening device of claim 1, formed from extruded plastic.

14. The wallboard-fastening device of claim 1, having a length that matches a length of the first and second wallboard panels.

15. The wallboard-fastening device of claim 1, wherein:

the ridges of the first flat-spring flange extend longitudinally along the first flat-spring flange; and the ridges of the second flat-spring flange extend longitudinally along the second flat-spring flange.

16. The wallboard-fastening device of claim 3, wherein:

a thickness of the first flat-spring flange decreases linearly along a width direction of the first tapered flat-spring flange; and a thickness of the second flat-spring flange decreases linearly along a width direction of the second tapered flat-spring flange.

17. The wallboard-fastening device of claim 1, the first flat-spring flange and the second flat-spring flange being tapered.

* * * * *